United States Patent [19]

Vaughn

[11] Patent Number: 4,694,657

[45] Date of Patent: Sep. 22, 1987

[54] ADAPTIVE DEFROST CONTROL AND METHOD

[75] Inventor: Eldon D. Vaughn, Brea, Calif.

[73] Assignee: Spectrol Electronics Corporation, City of Industry, Calif.

[21] Appl. No.: 855,267

[22] Filed: Apr. 24, 1986

Related U.S. Application Data

[62] Division of Ser. No. 50,352, Jun. 20, 1979, Pat. No. 4,680,940.

[51] Int. Cl.[4] ..... F25D 21/00

[52] U.S. Cl. ..... 62/80; 62/155

[58] Field of Search ..... 62/155, 156, 234, 80, 62/157, 158

[56] References Cited

U.S. PATENT DOCUMENTS

| | | | |
|---|---|---|---|
| 3,890,798 | 6/1975 | Fujimoto et al. | 62/156 X |
| 4,156,350 | 5/1979 | Elliott et al. | 62/155 X |
| 4,251,988 | 2/1981 | Allard et al. | 62/155 X |
| 4,251,999 | 2/1981 | Tanaka | 62/155 |

*Primary Examiner*—Harry Tanner

*Attorney, Agent, or Firm*—Robert P. Hayter

[57] ABSTRACT

Apparatus and a method for determining the appropriate time-to-initiate a defrost cycle in conjunction with a refrigeration circuit having a heat exchanger upon which frost may accumulate. The elapsed time period from a previous defrost cycle is used to adjust the time between defrost cycles such that the time period between defrost cycles is varied as a function of the length of the previous deforst cycle.

6 Claims, 2 Drawing Figures

ADAPTIVE DEFROST CONTROL AND METHOD

This is a division of application Ser. No. 050,352 filed on June 20, 1979 now U.S. Pat. No. 4,680,940.

BACKGROUND OF THE INVENTION

1. Field of the Invention

The present invention relates to a control mechanism for initiating a defrost cycle associated with a refrigeration circuit having a heat exchanger or other heat transfer element on which frost may form. More specifically, the present invention concerns a control device for varying the time between defrost cycle as a function of the length of the previous defrost cycle.

2. Description of the Prior Art

Air conditioners, refrigerators and heat pumps produce a controlled heat transfer by the evaporation in an evaporator chamber of a liquid refrigerant under pressure conditions which produce the desired evaporation temperatures. The liquid refrigerant absorbs its latent heat of vaporization from the medium being cooled and in this process is converted into a vapor at the same pressure and temperature. This vapor has its temperature and pressure increased by a compressor and is then conveyed into a condenser chamber in which the pressure is maintained at a predetermined level to condense the refrigerant at a desired temperature. The quantity of heat removed from a refrigerant in the condenser is the latent heat of condensation plus the super heat which has been added to the liquid refrigerant in the process of conveying the refrigerant from the evaporator pressure level to the condenser pressure level. After condensing, the liquid refrigerant is passed from the condenser through a suitable throttling device back to the evaporator to repeat the cycle.

In a closed cycle system, generally a mechanical compressor or pump is used to transfer the refrigerant vapor from the evaporator (low pressure side) to the condenser (high pressure side). The vaporized refrigerant drawn from the evaporator is compressed and delivered to the condenser wherein it undergoes a change in state from a gas to a liquid transferring heat energy to the condenser cooling medium. The liquefied refrigerant is then collected in the bottom of the condenser or in a separate receiver and fed back to the evaporator through the throttling device.

Evaporators of many different types are known in the art and all such evaporators are designed with the primary objective of affording easy transfer of heat from the medium being cooled to the evaporating refrigerant. In one commonly known type of evaporating system (direct expansion), refrigerant is introduced into the evaporator through a thermal expansion valve and makes a single pass in thermal contact with the evaporator surface prior to passing into the compressor suction line.

While the evaporator functions to collect refrigerant to pass from a liquid state into a vapor state extracting the latent heat of vaporization of the refrigerant from the surrounding medium, the function of the condenser is the reverse of the evaporator, i.e. to rapidly transfer heat from the condensing refrigerant to the surrounding medium. One of the frequently encountered well-known problems associated with air source heat pump equipment is that during heating operations the outdoor coil which is functioning as an evapoator tends to accumulate frost which reduces the efficiency of the system.

In order to periodically remove the accumulated frost, various defrosting systems have been devised such as heating the coils or reversing the operation of the system. However, whatever the particular defrosting system employed in the heat pump, it is necessary for the optimum system efficiency to determine when the outdoor coil should be defrosted.

The accumulation of frost on the heat exchange surfaces of the evaporator produces an insulating effect which reduces the heat transfer between the refrigerant flowing through the evaporator and the surrounding medium. Consequently, after a buildup of frost on the heat exchanger heat transfer surfaces the heat pump system will lose capacity and the entire system will operate less efficiently.

In order to obtain maximum system efficiency, it is desirable to select the optimum time-to-initiate defrost such that the heat pump system is not operated during those periods when there is sufficient frost buildup to substantially interfere with heat transfer between the refrigerant flowing through the evaporator and the surrounding medium. It is also desirable, however, to provide a minimum number of defrost cycles since each defrost cycle may result in removing heat from the enclosure to be conditioned, energizing electric resistance heaters, or reversing refrigeration systems such that heat normally supplied to the space to be conditioned is used to defrost the evaporator. Each defrost cycle detracts from the overall efficient performance of the heat pump system. Consequently, it is important to strike a balance between initiating defrost before heat transfer is substantially diminished by frost accretion and preventing the rapid cycling of the system between defrost and heating operations. This frost buildup situation is not only related to the evaporator of a heat pump but it finds like applicability in other cold applications wherein the evaporator is operated at a temperature below the freezing point of moisture in a surrounding medium such as a freezer compartment, a refrigerator, cold storage rooms, trailer refrigeration equipment, humidifiers, and supermarket display cases.

Different types of frost control systems have been utilized, varying from the use of the timer to periodically initiate and terminate defrost to sophisticated infrared radiation and sensing means mounted on the fins of the refrigerant carrying coils. Other such defrost systems generate a signal in response to an air pressure differential across the heat exchanger caused by frost accumulation blocking the airflow through the heat exchanger. Other defrost systems require coincidence between two independently operable variables each of which may indicate frost accumulation such as air pressure within the shroud of the evaporator and the temperature differential within the evaporator coil. Another system may be the combination of a periodic timer to initiate defrost with a thermostat for sensing refrigerant temperature to terminate defrost. Another defrost system is one wherein compressor current or another operational parameter is monitored and compared to a reference level signal developed during a non-frost condition such that a variation from that reference level of the parameter being monitored indicates that it is time-to-initiate the defrost cycle.

These defrost systems can generally be grouped into two specific categories: timed and demand. A timed system simply initiates defrost periodically whether frost has accumulated or not based on the knowledge that all heat pump systems will need periodic defrosting under certain weather conditions. The amount of time chosen for periodically initiating defrost is a compromise between a short time that would cause a waste of efficiency during weather conditions which do not necessitate defrost and a long time which would allow the heat pump to operate inefficiently with a severely frosted evaporator coil. The advantage of a timed defrost system is that the heat pump will be defrosted periodically. The disadvantage is that the needed time between defrosts is never quite the same as the preset time due to weather conditions which differ from day to day and location to location.

Demand defrost systems attempt to initiate a defrost cycle as a function of some system parameter which is related to a measure of frost accumulation. The advantage of a demand defrost system is that the heat pump is allowed to continue normal operation without energy consuming defrost cycles until defrost is actually required. The disadvantage of demand defrost systems is that initial equipment cost is high and demand systems are less reliable in their ability to sense the need for defrost.

The herein disclosed defrost control mechanism is a combination of timed and demand. The parameter being monitored is the elapsed time during a previous defrost cycle. The interval between defrost cycles is a continually changing time as a function of the time in defrost.

SUMMARY OF THE INVENTION

It is an object of this invention to provide a control mechanism for determining the appropriate time for defrost initiation.

Another object of this invention is to control initiation of a defrost cycle in response to the elapsed time period of the previous defrost cycle.

A further object of this invention is to vary the time periods between defrost cycles as a function of the length of the previous defrost cycle such that the buildup of frost on the heat transfer surface will not exceed a preselected level and such that the defrost cycle will only be initiated when a need is ascertained.

These and other objects are achieved according to a preferred embodiment of the present invention wherein there is disclosed a timing system for initiating defrost based upon the length of the previous defrost cycle. A defrost time accumulator monitors the elapsed time of a defrost cycle. A time-to-initiate clock emits periodic pulses which are counted by a counter. When the counter ascertains that a predetermined number of pulses have been emitted, a defrost initiation signal is generated. The rate at which the pulses are emitted by the time-to-initiate clock is adjusted as a function of the elapsed time of the previous defrost cycle such that the time-to-initiate period is either shortened or lengthened depending upon the elapsed time of the previous defrost cycle.

DESCRIPTION OF THE PREFERRED EMBODIMENT

The hereinafter described control mechanism and method will be described for use in conjunction with an air source heat pump. It is to be understood that this mechanism has like applicability to any heat transfer device having a surface or surfaces upon which frost may accumulate. This device will find like applicability to freezers, combination refrigerator-freezers, cold storage rooms or containers, refrigeration machines, dehumidifiers, supermarket display cases, and other similar apparatus. Furthermore, the control mechanism will be explained utilizing a vapor compression refrigeration circuit. Naturally, this control mechanism has like applicability to other types of refrigeration circuits.

Figure 1:
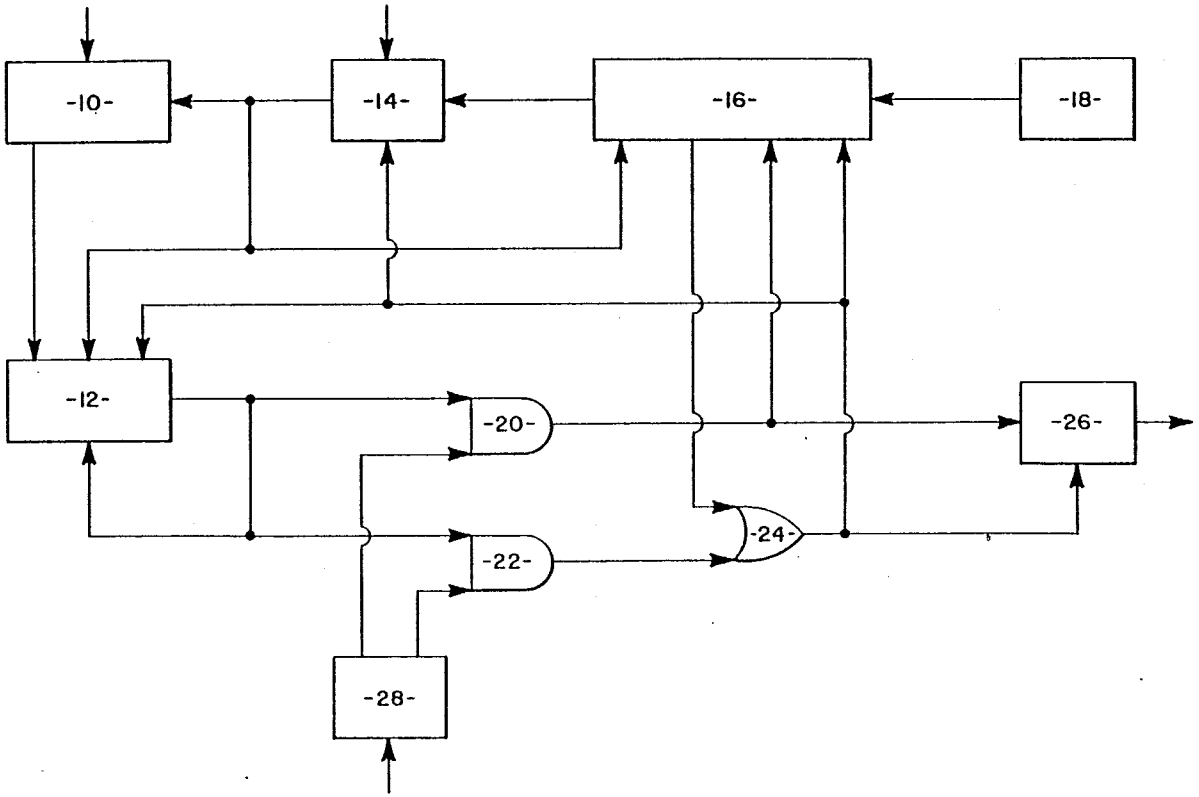
FIG. 1 is a functional block diagram of a defrost initiation mechanism for creating and terminating a defrost cycle in response to the elapsed time of the previous defrost cycle.

Referring now to FIG. 1, a block diagram of the defrost cycle mechanism, it can be seen that time-to-initiate clock 10 is connected to time-to-initiate counter 12. The output of time-to-initiate counter 12 is connected to AND gate 20, AND gate 22, and back to time-to-initiate counter 12. Defrost time accumulator 16 has an input signal from real-time clock 18 and has its output connected to rate logic 14. Rate logic 14 has its output connected to time-to-initiate clock 10 such that rate of the time-to-initiate clock may be varied thereby, to time-to-initiate counter 12 for starting the time-to-initiate counter and to defrost time accumulator16 for resetting said defrost time accumulator. AND gate 20 has its output connected to defrost time accumulator 16 and defrost relay latch 26. AND gate 22 has its output connected to OR gate 24. Defrost thermostat latch 28 receives a signal from a defrost thermostat and has its output connected to AND gate 20 and to AND gate 22.

Defrost time accumulator 16 has a maximum time override output also connected to OR gate 24. The output of OR gate 24 is connected to defrost relay latch 26 for deenergizing same, to defrost time accumulator 16 for indicating the termination of defrost, to rate logic 14 to cause the calculation of a new time-to-initiate clock rate and to time-to-initiate counter 12 to reset same.

Figure 2:
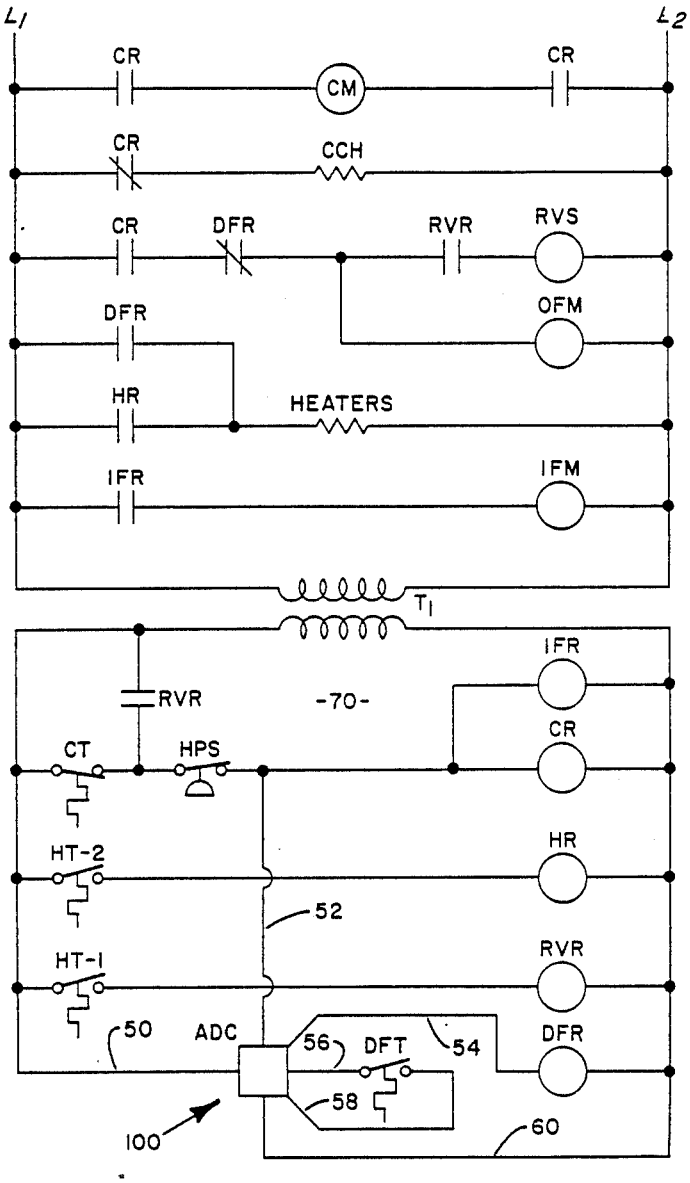
FIG. 2 is a functional block and schematic diagram showing the manner in which the defrost initiating system may be incorporated with the circuitry of a typical heat pump.

Referring now to FIG. 2, there can be seen a schematic block diagram of a typical heat pump system having power supplied thereto through lines L-1 and L-2. Connected therebetween through normally open compressor relay contacts CR is compressor motor CM. Additionally, crankcase heater CCH is connected between L-1 and L-2 by normally closed compressor relay contacts CR. Normally open compressor relay contacts CR are located in series with normally closed defrost relay contacts DFR as are normally open relay contacts RVR with reversing valve solenoid RVS between lines L-1 and L-2. An outdoor fan motor OFM for powering the outdoor fan of the heat pump system is connected in series with normally open compressor relay contacts CR and normally closed relay contacts DFR.

Auxiliary electric resistance heaters are connected to L-1 and L-2 in parallel with normally open heating relay contacts HR and normally open defrost relay contacts DFR. Additionally, indoor fan motor IFM is connected between lines L-1 and L-2 by normally open indoor fan relay contacts IFR. Transformer T-1 is connected between lines L-1 and L-2 such that the transformer reduces the voltage from lines L-1 and L-2 connected to the primary transformer winding to the voltage of the secondary winding connected to control circuit portion 70 of FIG. 2.

In the control circuit portion it can be seen that the cooling thermostat CT is connected in series with high pressure switch HPS and compressor relay CR as well as indoor fan relay IFR. Heating thermostat 2, HT-2 is connected in series with heating relay HR. Heating thermostat 1, HT-1 is connected in series with reversing valve relay RVR. Reversing valve relay contacts RVR in the normally open position are connected between the secondary of transformer T-1, cooling thermostat CT and high pressure switch HPS. Adaptive defrost control ADC is shown connected between the two legs of the secondary winding of transformer T-1 and is in series with defrost relay DFR.

Adaptive defrost control 100 is shown connected by wire 50 to one side of the secondary transformer T-1 and by wire 60 to the common side of the transformer T-1. Wire 52 connects the adaptive defrost control with the wire utilized to energize compressor relay CR when the compressor motor is to be operated. Wire 54 connects adaptive defrost control with the defrost relay for energizing same. Wires 56 and 58 connect the adaptive defrost control with the defrost thermostat, DFT.

OPERATION

When the heat pump is in the cooling mode of operation and a cooling need is sensed cooling thermostat CT closes energizing through high pressure switch HPS compressor relay CR and indoor fan relay IFR. The closing of the compressor relay contacts and the indoor fan relay contacts result in compressor motor CM being energized, crankcase heater CCH being deenergized, outdoor fan motor OFM being energized through the now closed compressor relay contacts and the normally closed defrost relay contacts, and the indoor fan motor being energized through the indoor fan relay contacts. During the cooling mode of operation the heat pump should not experience defrost problems and consequently, adaptive defrost control 100 is not utilized.

During the heating season, upon a need for heating being sensed, heating thermostat 1, HT-1 will close energizing reversing valve relay RVR. When reversing valve relay RVR is energized the RVR normally open contacts in the control portion of the circuit will close energizing through the high pressure switch, compressor relay CR and indoor fan relay IFR. The closing of the compressor relay contacts and the indoor fan relay contacts will energize the compressor motor, the outdoor fan motor and the indoor fan motor. The RVR relay further acts to close the normally open reversing valve relay contacts RVR in the power portion of the circuit operating reversing valve solenoid RVS such that the refrigerant flow within the heat pump is reversed to provide heating to the enclosure.

Should heat pump operation fail to fully satisfy the heating requirements of the enclosure the temperature of the enclosure will continue to drop and heating thermostat 2, HT-2 will close energizing heating relay HR. Heating relay HR when energized closes heating relay contacts HR which will energize electric resistance heaters for providing additional heat to the enclosure. During the time that the compressor relay is energized the adaptive defrost control will receive a signal from wire 52 indicating that the heat pump system is being operated. Upon the adaptive defrost control determining that it is necessary to enter a defrost cycle, defrost relay DFR will be energized. The energization of the defrost relay will result in a normally closed DFR contacts opening thereby deenergizing the outdoor fan motor and the reversing valve solenoid such that the heat pump system will switch to cooling mode of operation providing heat to the outdoor coil. Deenergization of the outdoor fan motor will limit the transfer of heat to the medium surrounding the outdoor coil. Additionally, by energizing the defrost relay the normally open defrost relay contacts DFR will close energizing electric resistance heaters for supplying heat to the enclosure while the heat pump is in the defrost mode of operation.

Referring now to FIG. 1, it can be seen that through defrost relay latch 26 a signal is emitted to energize or deenergize the defrost relay. Defrost thermostat latch 28 receives a signal from the defrost thermostat which is typically mounted to sense the temperature of the refrigerant leaving the heat exchanger upon which frost accumulates. During operation of the heat pump system the elapsed time period of the previous defrost cycle is stored in the defrost time accumulator 16. The output of AND gate 20 acts to start the defrost time accumulator to indicate that a new defrost cycle has been initiated. The output of OR gate 24 acts to stop the defrost time accumulator to indicate that the defrost cycle has terminated. Consequently the time between the start and stop signals is the defrost cycle elapsed time. Real-time clock 18 inputs into the defrost time accumulator such that a reference will be available for computing the elapsed time of the defrost cycle. The defrost time accumulator provides a signal to rate logic 14 to indicate the length of the defrost cycle. Rate logic 14 then acts to adjust the pulse emission rate of time-to-initiate clock 10 such that the periodic pulses emitted by the clock may be emitted either more rapidly or more slowly depending upon the length of the previous defrost cycle. A new rate is calculated when OR gate 24 emits a signal to stop the previous defrost cycle. Once this new rate is calculated the output of rate logic 14 is also used as the start signal for time-to-initiate counter 12 and as the signal to reset defrost time accumulator 16.

Time-to-initiate clock 10 receives the rate control instructions from rate logic 14 and emits periodic pulses having a varying rate depending upon the instructions received from logic 14. Time-to-initiate clock 10 monitors a parameter of the heat transfer system to indicate for what time period the system has been operating. It can be seen in FIG. 2 herein that wire 52 is connected to monitor the compressor running time such that the time-to-initiate clock will emit pulses during the time period the compressor motor is operating.

The output of the time-to-initiate clock 10 is received by time-to-initiate counter 12. Time-to-initiate counter 12 counts the pulses emitted by the time-to-initiate clock 10 and upon reaching a preselected number emits a defrost initiation signal. This defrost initiation signal is received by AND gate 20, AND gate 22 and time-to-initiate counter 12. This defrost initiation signal is received by AND gate 20 as well as a signal from defrost latch 28 indicating that defrost thermostat 28 is closed. When AND gate 20 receives both signals signifying that the defrost thermostat is closed and that the time-to-initiate counter indicates that it is time-to-initiate a defrost cycle, then a signal is emitted by AND gate 20 to energize defrost relay latch 26 for energizing the defrost relay and to start the defrost time accumulator for ascertaining the length of the defrost cycle.

AND gate 22 also receives a defrost initiation signal from time-to-initiate counter 12 and a signal from defrost thermostat latch 28 which indicates the defrost thermostat is open. Should AND gate 22 receive both these signals simultaneously indicating that counter 12 states that it is time-to-initiate a defrost cycle and that the defrost thermostat is in the open position then AND gate 22 will emit a signal to OR gate 24. OR gate 24 is connected to receive both the signal from AND gate 22 and a maximum time override signal from defrost accumulator 16, said override signal preventing the defrost cycle from exceeding a certain maximum time such as ten minutes. Upon the receipt of either signal by OR gate 24 a signal to deenergize defrost relay latch 26 and the defrost relay will be emitted, said signal also acting to stop defrost time accumulator 16 from further counting the elapsed time during defrost, to initiate a new rate calculation by rate logic 14 and to reset the time-to-initiate counter at the start position.

Rate logic 14 may include apparatus to provide a reference signal based on an average defrost cycle time and then calculate the rate to be used by comparing the output of defrost time accumulator 16 to that reference level. Should the output of defrost time accumulator 16 exceed the reference level indicating a longer defrost cycle it would be anticipated that rate logic 14 would then act to increase the rate at which the time-to-initiate clock 10 emits pulses thus shortening the period between successive defrost cycles. Should the signal emitted by defrost time accumulator 16 indicate a shorter defrost cycle than the reference cycle then the rate logic would emit a signal slowing the pulse emission rate of the time-to-initiate clock 10 thereby increasing the time-to-initiate between defrost cycles.

The theory behind the described defrost initiation control is that it is only desirable to engage a defrost cycle when a fixed amount of frost has accumulated on the heat transfer surface such as to impede heat transfer between the cooling medium and the medium to be cooled. It is additionally surmised that assuming a constant rate of heat input to the heat exchanger then the length of the time in defrost cycle necessary to melt the frost formed thereon will be indicative of the amount of frost formed on the heat transfer surface. Consequently, if less frost forms on the heat transfer surface it will require less time to defrost and a longer time between defrost cycles may be utilized. If more time is required for defrost than the reference period then the build-up of frost is larger than anticipated and the next defrost cycle should be initiated earlier.

The above defrost initiation mechanism has been described in reference to a heat pump. As stated earlier, it finds like applicability in any heat transfer element upon which frost may accumulate.

While the invention has been described with reference to a preferred embodiment, it will be understood by those skilled in the art that various changes may be made and equivalents may be substituted for the elements thereof without departing from the scope of the invention. In addition, many modifications may be made to adapt a particular situation or material to teachings of the invention without departing from the essential scope thereof. Therefore, it is intended that the invention not be limited to the particular embodiment disclosed as the best mode contemplated for carrying out this invention, but that the invention will include all the embodiments falling within the scope of the appended claims.

I claim:

1. A method of determining the appropriate time-to-initiate a defrost cycle for effecting a change in operation of a refrigeration circuit to remove frost from a heat exchanger forming a part of the refrigeration circuit comprising the steps of detecting the period of elapsed time during the previous defrost cycle, selecting a time period for which the refrigeration circuit should be operated between defrost cycles based upon the elapsed time during the previous defrost cycle, monitoring the cumulative operating time of the refrigeration circuit between defrost cycles, comparing the cumulative operating time of the refrigeration circuit with the time period formulated by the step of selecting to ascertain the appropriate time-to-initiate the next defrost cycle, said appropriate time occuring when the cumulative operating time equals the preselected time, wherein the step of monitoring the cumulative operating time includes energizing a time-to-initiate clock which emits periodic pulses when the refrigeration circuit is operating and further includes counting the pulses emitted by the clock; and wherein the time-to-initiate clock has a variable pulse emission rate and wherein the step of selecting a time period includes controlling the rate at which pulses are emitted from the time-to-initiate clock.

2. The method as set forth in claim 1 wherein the step of comparing includes emitting a defrost initiation signal when the number of pulses counted by step of counting reach a preselected value.

3. The method as set forth in claim 1 and further including the steps of:

sensing a temperature in the refrigeration circuit, and emitting a defrost initiation signal when the temperature sensed is within a predetermined range and when the step of comparing ascertains the appropriate elapse of cumulative operating time.

4. A method of determining when a defrost cycle should be initiated to remove frost from a heat transfer element associated with a refrigeration circuit which comprises the steps of:

ascertaining the elapsed time period during the previous defrost cycle, creating a defrost initiation signal after the expiration of a time-to-initiate a time period, said time period commencing upon the termination of the preceding defrost cycle, and regulating the length of the time-to-initiate period as a function of the elapsed time period of the previous defrost cycle by adjusting the rate at which a clock emits pulses as a function of length of the previous defrost cycle, said defrost initiation signal being created upon a predetermined number of said clock pulses having been counted.

5. The method as set forth in claim 4 wherein the step of regulating includes comparing the length of the defrost cycle to a reference value and adjusting length of the time-to-initiate period in response thereto.

6. The method as set forth in claim 4 wherein the step of creating includes energizing the clock emitting periodic pulses at the termination of a defrost cycle, and counting the pulses such that the defrost initiation signal is generated after a selected number of pulses have been emitted by the clock.

* * * * *